US011056261B2

(12) United States Patent
Nakashima et al.

(10) Patent No.: US 11,056,261 B2
(45) Date of Patent: Jul. 6, 2021

(54) INDUCTOR

(71) Applicant: Murata Manufacturing Co., Ltd., Kyoto-fu (JP)

(72) Inventors: Yasunari Nakashima, Nagaokakyo (JP); Hiromi Miyoshi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 202 days.

(21) Appl. No.: 16/128,839

(22) Filed: Sep. 12, 2018

(65) Prior Publication Data

US 2019/0088396 A1 Mar. 21, 2019

(30) Foreign Application Priority Data

Sep. 20, 2017 (JP) ..... JP2017-180454

(51) Int. Cl.

*H01F 27/29* (2006.01)
*H01F 17/00* (2006.01)
*H01F 27/28* (2006.01)

(52) U.S. Cl.

CPC ..... *H01F 17/0013* (2013.01); *H01F 27/2804* (2013.01); *H01F 27/29* (2013.01); *H01F 27/292* (2013.01); *H01F 2017/002* (2013.01); *H01F 2017/004* (2013.01); *H01F 2017/0073* (2013.01)

(58) Field of Classification Search

CPC ..... H01F 17/0013; H01F 27/292; H01F 27/2804; H01F 2017/004; H01F 2017/0073; H01F 2017/002; H01F 27/324; H01F 2027/2809

See application file for complete search history.

(56) References Cited

U.S. PATENT DOCUMENTS

2017/0103846 A1 4/2017 Yoneda

FOREIGN PATENT DOCUMENTS

| | | | | |
|---|---|---|---|---|
| CN | 106062904 A | | 10/2016 | |
| JP | 2001-044033 A | | 2/2001 | |
| JP | 2001044033 A | * | 2/2001 | |
| JP | 2013-153009 A | | 8/2013 | |
| JP | 2014107513 A | * | 6/2014 | ..... H01F 17/0013 |
| JP | 2014-175383 A | | 9/2014 | |

(Continued)

OTHER PUBLICATIONS

An Office Action; "Notification of Reasons for Refusal," Mailed by the Japanese Patent Office dated Nov. 19, 2019, which corresponds to Japanese Patent Application No. 2017-180454 and is related to U.S. Appl. No. 16/128,839; with English language translation.

(Continued)

*Primary Examiner* — Tuyen T Nguyen
(74) *Attorney, Agent, or Firm* — Studebaker & Brackett PC

(57) ABSTRACT

An inductor includes a coil that is provided in a component body. A first end of the coil is connected to a first outer electrode, and a second end of the coil is connected to a second outer electrode. The coil includes a plurality of coil conductor layers that are provided in a width direction. Each coil conductor layer is substantially spirally formed with the number of turns being greater than or equal to about one turn. The height of the component body is greater than the width of the component body.

18 Claims, 5 Drawing Sheets

(56) References Cited

FOREIGN PATENT DOCUMENTS

| | | | | | |
|---|---|---|---|---|---|
| JP | 2017011044 | A | * | 1/2017 | ..... H01F 27/292 |
| WO | 2016-006542 | A1 | | 1/2016 | |

OTHER PUBLICATIONS

An Office Action issued by the China National Intellectual Property Administration dated Aug. 11, 2020, which corresponds to Chinese Patent Application No. 201811092536.5 and is related to U.S. Appl. No. 16/128,839 with English language translation.

* cited by examiner

INDUCTOR

CROSS-REFERENCE TO RELATED APPLICATION

This application claims benefit of priority to Japanese Patent Application No. 2017-180454, filed Sep. 20, 2017, the entire content of which is incorporated herein by reference.

BACKGROUND

Technical Field

The present disclosure relates to an inductor.

Background Art

Hitherto, electronic components have been installed in various electronic apparatuses. As one electronic component, for example, a multilayer inductor is known as described, for example, in Japanese Unexamined Patent Application Publication No. 2013-153009.

Due to high frequencies of electronic apparatuses, such as cellular phones, a small inductor that allows the use of high frequency signals is required for electronic apparatuses. In order to reduce the size of inductors, the inductance value (L value) and the Q value are reduced. Therefore, in inductors that are used for high frequency signals, improvements in characteristics, such as the inductance value (L value) and the Q value, are required.

However, in inductors such as the inductor in Japanese Unexamined Patent Application Publication No. 2013-153009, when the inductance value increases, the number of coil conductor layers increases. Therefore, the multilayer body increases in a lamination direction, and a mounting area of the inductor increases. In inductors such as the inductor in Japanese Unexamined Patent Application Publication No. 2013-153009, when, in order to increase the inductance value, the number of turns of the coil conductor layers is made greater than or equal to about one turn, an inner region of each coil conductor layer becomes small, and the Q value decreases.

SUMMARY

The present disclosure thus provides an inductor having desired characteristics.

According to preferred embodiments of the present disclosure, there is provided an inductor including a substantially rectangular parallelepiped component body that includes a mounting surface at which a first outer electrode and a second outer electrode are exposed; and a coil that is provided at the component body. A first end of the coil is connected to the first outer electrode, a second end of the coil being connected to the second outer electrode. The coil includes a plurality of coil conductor layers that are arranged in a first direction parallel to the mounting surface, and that are substantially spirally formed with the number of turns being greater than or equal to about one in a plane perpendicular to the first direction; and a plurality of via conductor layers that connect the coil conductor layers that are adjacent to each other to each other in the first direction. A height of the component body in a direction orthogonal to the mounting surface is larger than a width of the component body in the first direction.

According to this structure, the component body is such that the area of principal surfaces of a plurality of insulator layers that are laminated in a width direction is larger than that of an inductor whose width is less than or equal to its height. Therefore, it is possible to increase the outside diameter of the coil (coil conductor layers) and to increase the length of the coil. Consequently, the range of inductance values (L values) of the inductor that are acquired is increased. In addition, it is possible to increase the inside diameter of each substantially spiral coil conductor layer. Therefore, the Q value of the inductor is increased.

According to the preferred embodiments of the present disclosure, in the inductor, it is desirable that the component body include a first end surface and a second end surface that are orthogonal to the mounting surface and that are parallel to the first direction. The first outer electrode is embedded in the component body, and has a substantially L shape so as to be exposed continuously from the mounting surface to the first end surface. The second outer electrode is embedded in the component body, and has a substantially L shape so as to be exposed continuously from the mounting surface to the second end surface.

According to this structure, compared to a case in which the outer electrodes are externally attached to the component body, it is possible to reduce the size of the inductor. In addition, it is possible to increase the efficiency with which the inductance value of the inductor with respect to the mounting area is acquired.

According to the preferred embodiments of the present disclosure, in the inductor, it is desirable that the plurality of coil conductor layers each include a substantially spiral winding portion and a via pad for connecting the via conductor layer corresponding thereto. When viewed from the first direction, each winding portion includes a portion that extends along a substantially ring-shaped outer peripheral track, a portion that extends along a substantially ring-shaped inner peripheral track on an inner side of the outer peripheral track, and a connection portion that connects the portion that extends along the outer peripheral track and the portion that extends along the inner peripheral track. At least one of the plurality of via pads provided at the portions that extend along the outer peripheral tracks of the winding portions of the coil is provided at a location that does not overlap the first outer electrode in a second direction perpendicular to the first end surface.

The first outer electrode and the second outer electrode that are embedded in the component body act to decrease the outside diameters of the coil conductor layers. However, at least one of the via pads is provided at a location that does not overlap the first outer electrode (the second outer electrode) in the second direction that is perpendicular to the first end surface. Therefore, it is possible to form the winding portions of the coil conductor layers close to the first outer electrode (the second outer electrode). Consequently, it is possible to increase the outside diameters of the coil conductor layers.

According to the preferred embodiments of the present disclosure, in the inductor, it is desirable that the plurality of coil conductor layers each include a substantially spiral winding portion and a via pad for connecting the via conductor layer. When viewed from the first direction, each winding portion includes a portion that extends along a substantially ring-shaped outer peripheral track, a portion that extends along a substantially ring-shaped inner peripheral track on an inner side of the outer peripheral track, and a connection portion that connects the portion that extends along the outer peripheral track and the portion that extends along the inner peripheral track. The via pads are not formed at at least one of a first region and a second region. The first region overlaps the first outer electrode in a direction perpendicular to the first end surface and in a direction perpendicular to the mounting surface at the first outer electrode. The second region overlaps the second outer electrode in a direction perpendicular to the second end surface and in the direction perpendicular to the mounting surface at the second outer electrode.

The first outer electrode and the second outer electrode that are embedded in the body component act to decrease the outside diameters of the coil conductor layers. However, since the via pads are not formed at the first region, it is possible to form the winding portions of the coil conductor layers close to the first outer electrode. Similarly, since the via pads are not formed at the second region, it is possible to form the winding portions of the coil conductor layers close to the second outer electrode. Therefore, it is possible to increase the outside diameters of the coil conductor layers.

According to the preferred embodiments of the present disclosure, in the inductor, it is desirable that each via pad that is connected to the winding portion at a corresponding one of the outer peripheral tracks protrude to an outer side of the corresponding one of the outer peripheral tracks. Also, each via pad that is connected to the winding portion at a corresponding one of the inner peripheral tracks protrudes to an inner side of the corresponding one of the inner peripheral tracks.

According to this structure, when each via pad at the corresponding outer peripheral track is formed so as to protrude to the outer side of the corresponding outer peripheral track, the outside diameter of each winding portion at the corresponding inner peripheral track is increased. When each via pad at the corresponding inner peripheral track is formed so as to protrude to the inner side of the corresponding inner peripheral track, the outside diameter of each winding portion at the corresponding inner peripheral track, that is, the inside diameter of each winding portion is increased. Therefore, the Q value of the inductor is increased.

According to the preferred embodiments of the present disclosure, in the inductor, it is desirable that the component body include a plurality of insulator layers that are laminated in the first direction, each coil conductor layer be substantially spirally formed at one principal surface of a corresponding one of the insulator layers, and the plurality of via conductor layers extend through the insulator layers corresponding thereto in a thickness direction. According to this structure, the component body is easily formed by the plurality of insulator layers. In addition, the plurality of coil conductor layers are connected to each other by the corresponding via conductor layers extending through the corresponding insulator layers, and the coil is easily formed.

According to the preferred embodiments of the present disclosure, in the inductor, it is desirable that each insulator layer be a nonmagnetic body. According to this structure, an inductor that is suitable for high-frequency signals is acquired.

According to the preferred embodiments of the present disclosure, it is possible to provide an inductor having desired characteristics.

Other features, elements, characteristics and advantages of the present disclosure will become more apparent from the following detailed description of preferred embodiments of the present disclosure with reference to the attached drawings.

DETAILED DESCRIPTION

An embodiment is described below.

In order to facilitate understanding, the accompanying figures may show structural elements in enlarged form. The size ratio of the structural elements may differ from the actual size ratio or from the size ratio in other figures. In order to facilitate understanding, in the sectional views, some of the structural elements may not be marked by hatching.

Figure 1:
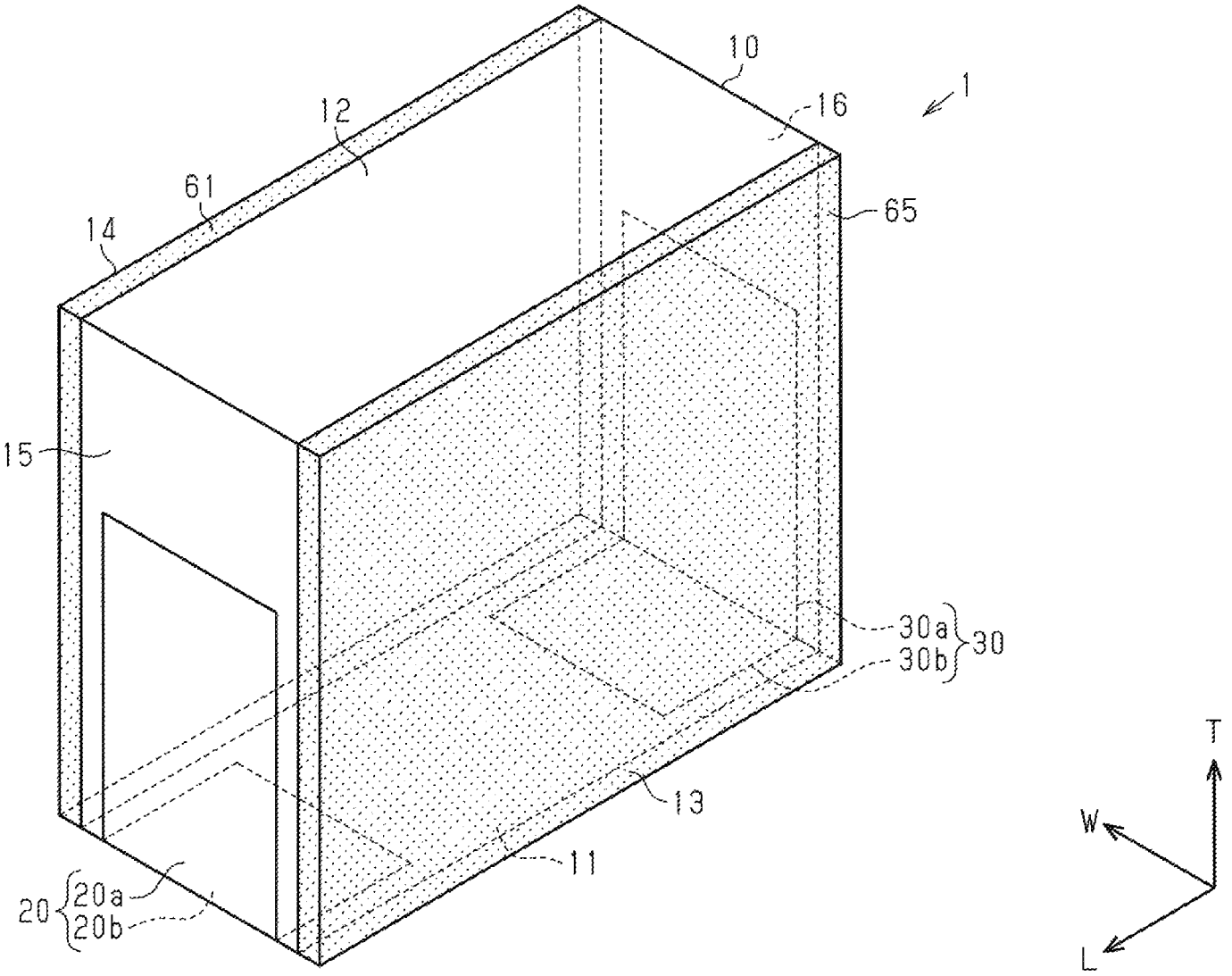
FIG. 1 is a perspective view of an inductor according to an embodiment.

As shown in FIG. 1, an inductor 1 includes a component body 10. The component body 10 is formed schematically with a substantially rectangular parallelepiped shape. In the specification, the term "substantially rectangular parallelepiped shape" refers to a substantially rectangular parallelepiped in which a corner or a ridge portion is chamfered, and a substantially rectangular parallelepiped in which a corner or a ridge portion is rounded. For example, an uneven portion may be formed in a part of or in the entire principal surface and side surface. In the substantially rectangular parallelepiped, opposing surfaces need not be completely parallel to each other, and may be slightly inclined with respect to each other.

The component body 10 includes a mounting surface 11. The mounting surface 11 refers to a surface facing a circuit board when the inductor 1 is to be mounted on the circuit board. The component body 10 also includes an upper surface 12 that is parallel to the mounting surface 11. The component body 10 also includes two pairs of surfaces that are orthogonal to the mounting surface 11. Of the two pairs of surfaces, the surfaces of one pair are a first side surface 13 and a second side surface 14, and the surfaces of the other pair are a first end surface 15 and a second end surface 16.

Figure 2:
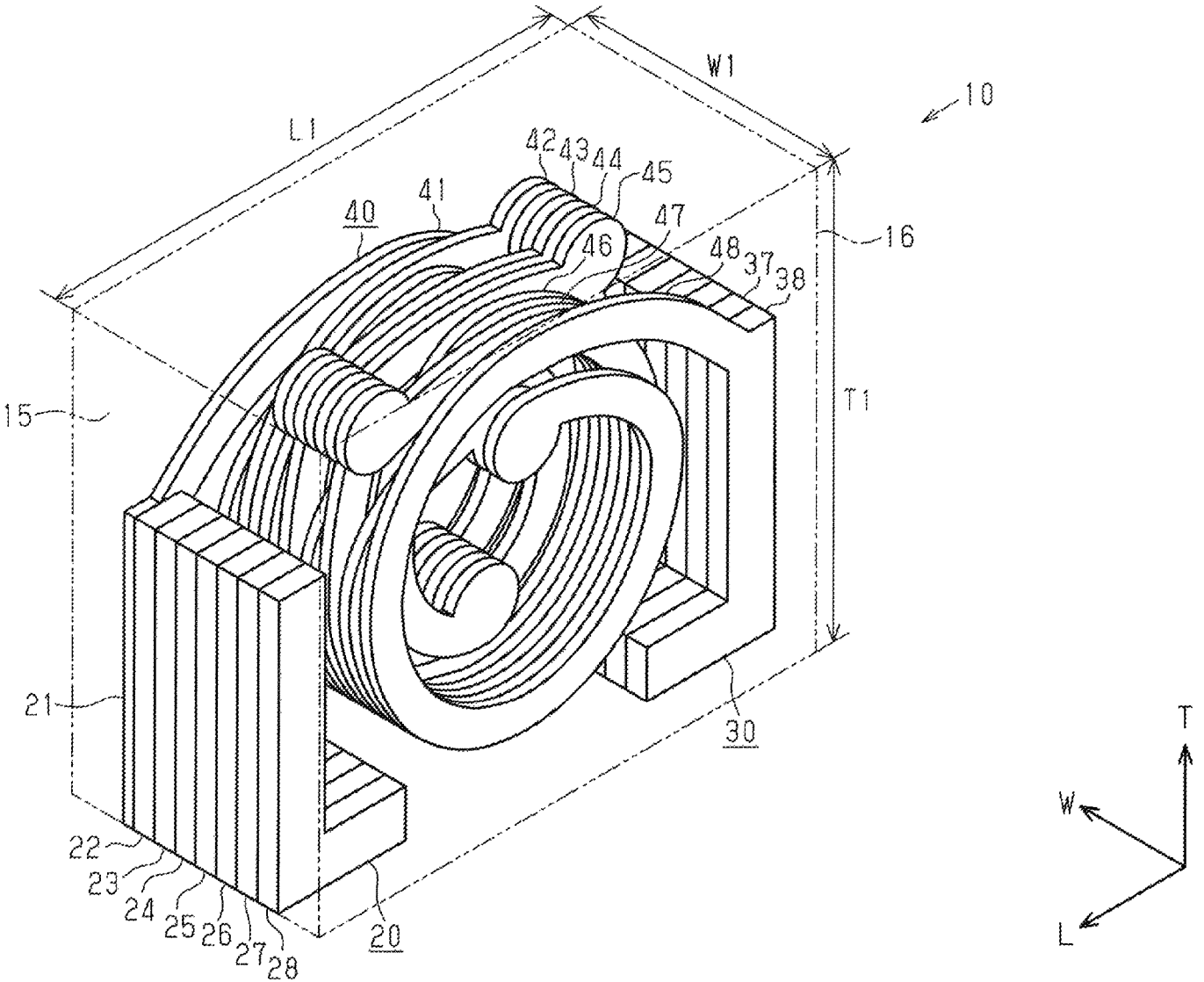
FIG. 2 is a perspective view of coil conductor layers and outer electrodes of the inductor of the embodiment.

In the specification, a direction that is perpendicular to the upper surface 12 and the mounting surface 11 is a "height direction", a direction that is perpendicular to the first side surface 13 and the second side surface 14 is a "width direction", and a direction that is perpendicular to the first end surface 15 and the second end surface 16 is a "length direction". As specific exemplifications, "length direction L", "height direction T", and "width direction W" are shown in FIGS. 1 and 2. The size in the "width direction" is a "width", the size in the "height direction" is a "height", and the size in the "length direction" is a "length".

It is desirable that the size of the component body 10 in the length direction L (length L1) be greater than about 0 mm and less than or equal to about 1.0 mm (i.e., from about 0 mm to about 1.0 mm). For example, as indicated in FIG. 2, the length L1 is 0.6 mm. It is desirable that the size of the component body 10 in the width direction W (width W1) be greater than about 0 mm and less than or equal to about 0.6 mm (i.e., from about 0 mm to about 0.6 mm). It is desirable that the width W1 be less than or equal to about 0.36 mm, and more desirable that the width W1 be less than or equal to about 0.33 mm. For example, the width W1 of the component body 10 is 0.3 mm. It is desirable that the size of the component body 10 in the height direction T (height T1) be greater than about 0 mm and less than or equal to about 0.8 mm (i.e., from about 0 mm to about 0.8 mm). For example, the height T1 of the component body 10 is 0.4 mm. In the embodiment, the height T1 of the component body 10 is greater than the width W1 of the component body 10 (T1>W1).

The inductor 1 includes a first outer electrode 20 and a second outer electrode 30, each of which is exposed at corresponding surfaces of the component body 10. The first outer electrode 20 is exposed at the mounting surface 11 of the component body 10. In addition, the first outer electrode 20 is exposed at the first end surface 15 of the component body 10. The second outer electrode 30 is exposed at the mounting surface 11 of the component body 10. In addition, the second outer electrode 30 is exposed at the second end surface 16 of the component body 10. That is, the first outer electrode 20 and the second outer electrode 30 are exposed at the mounting surface 11. In other words, the surface of the component body 10 at which the first outer electrode 20 and the second outer electrode 30 are exposed is the mounting surface 11.

The first outer electrode 20 is formed at the first end surface 15 with a length that is substantially equal to ⅔ of the height of the component body 10 from the mounting surface 11 of the component body 10. The first outer electrode 20 is formed in substantially the center of the component body 10 in the width direction W. The width of the first outer electrode 20 is less than the width of the component body 10. The second outer electrode 30 is formed at the second end surface 16 with a height that is substantially equal to ⅔ of the height of the component body 10 from the mounting surface 11 of the component body 10. In the embodiment, the second outer electrode 30 is formed in substantially the center of the component body 10 in the width direction W. The width of the second outer electrode 30 is less than the width of the component body 10. The width of the second outer electrode 30 may be equal to the width of the component body 10.

As shown in FIG. 2, the inductor 1 includes a coil 40 that is provided in the component body 10. A first end of the coil 40 is connected to the first outer electrode 20, and a second end of the coil 40 is connected to the second outer electrode 30. In FIG. 2, the component body 10 is shown by alternate long and two short dash lines to make it easier to see the coil 40, the first outer electrode 20, and the second outer electrode 30.

The first outer electrode 20 has a substantially L shape. The first outer electrode 20 includes an end surface electrode 20*a* that is exposed at the first end surface 15 of the component body 10 and a lower surface electrode 20*b* that is exposed at the mounting surface 11 of the component body 10. That is, the first outer electrode 20 is exposed continuously at the component body 10 from the mounting surface 11 to the first end surface 15.

The second outer electrode 30 has a substantially L shape. The second outer electrode 30 includes an end surface electrode 30*a* that is exposed at the second end surface 16 of the component body 10 and a lower surface electrode 30*b* that is exposed at the mounting surface 11 of the component body 10. That is, the second outer electrode 30 is exposed continuously at the component body 10 from the mounting surface 11 to the second end surface 16.

An inductor that includes a covering layer that covers the first outer electrode 20 and the second outer electrode 30 may be used. As the material of the covering layer, a material having a high solder resistance or a high wettability may be used. For example, metals, such as nickel (Ni), copper (Cu), tin (Sn), and gold (Au), or alloys of such metals may be used. The covering layer may also include a plurality of layers. For example, the covering layer includes a Ni plating that covers the first outer electrode 20 and the second outer electrode 30, and a Sn plating that covers a surface of the Ni plating. The covering layer prevents oxidation at the surface of the first outer electrode 20 and the surface of the second outer electrode 30. The covering layer may protrude from the component body 10, or may be formed flush with the surfaces of the component body 10.

As shown in FIG. 2, the first outer electrode 20 includes a plurality of outer conductor layers 21 to 28 that are provided in the width direction W. The plurality of outer conductor layers 21 to 28 are connected to each other in the width direction W, and form one first outer electrode 20. Similarly, the second outer electrode 30 includes a plurality of outer conductor layers 31 to 38 that are provided in the width direction W. The plurality of outer conductor layers 31 to 38 are connected to each other in the width direction W, and form one second outer electrode 30. The outer conductor layers 21 to 28 and 31 to 38 need not contact each other at entire surfaces in the width direction. Layers that have slightly small shapes, that are connected to each other through vias, or that do not contact each other at all may be included. The coil 40 includes a plurality of coil conductor layers 41 to 48 that are provided in the width direction W. The plurality of coil conductor layers 41 to 48 are connected to each other by via conductor layers (described later), and form the coil 40.

Figure 3:
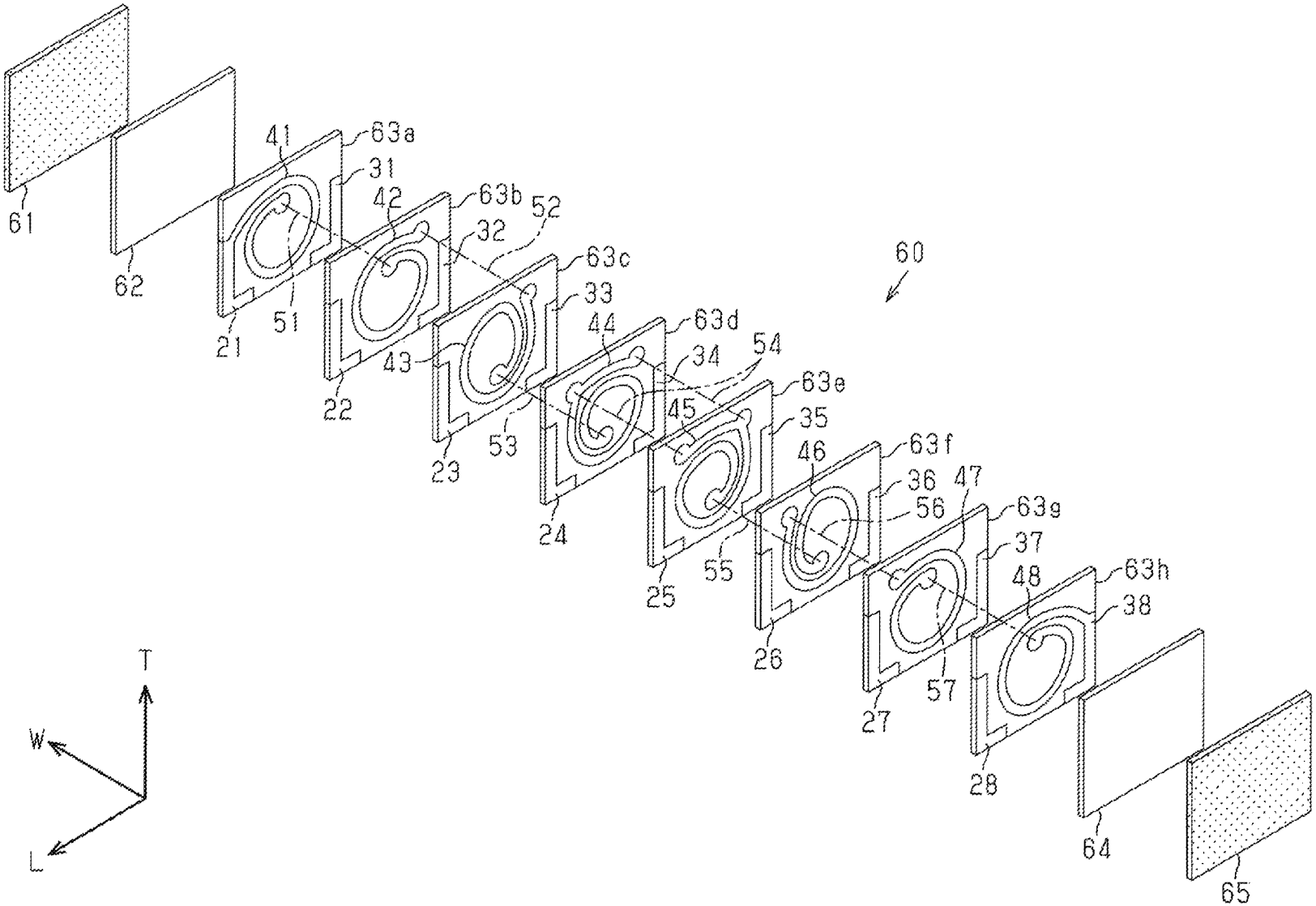
FIG. 3 is an exploded perspective view of the inductor.

As shown in FIG. 3, the component body 10 includes a plurality of insulator layers 60. In the embodiment, when the plurality of insulator layers are not to be distinguished, reference sign 60 is used, whereas when they are to be individually distinguished, reference signs 61, 62, 63*a* to 63*h*, 64, and 65 are used. The plurality of insulator layers 60 each have the form of a substantially rectangular plate. These insulator layers 60 that have been laminated form the component body 10 with a substantially rectangular parallelepiped shape. As the material of the insulator layers 60, a nonmagnetic material may be used. As the material of the insulator layers 60, a magnetic material may also be used. Examples of materials of the insulator layers 60 include an insulating material whose main component is borosilicate glass, alumina, zirconia, and an insulating resin, such as polyimide resin. In the component body 10, the interfaces of the plurality of insulator layers 60 may not be definite due to, for example, firing or solidification.

The colors of the insulator layers 61 and 65 differ from those of the other insulator layers 62, 63*a* to 63*h*, and 64. In FIG. 1, these insulator layers 61 and 65 are shown as being distinguished from the other insulator layers by hatching and solid lines. This makes it possible to detect that, for example, the inductor 1 has turned over when mounting the inductor 1. The colors of the insulator layers 61 and 65 may be the same as the colors of the other insulator layers 62, 63*a* to 63*h*, and 64. As long as their lengths L1, their widths W1, and their heights T1 differ, it is possible to detect that, for example, the inductor 1 has turned over even if the colors are the same as mentioned above.

Figure 4:
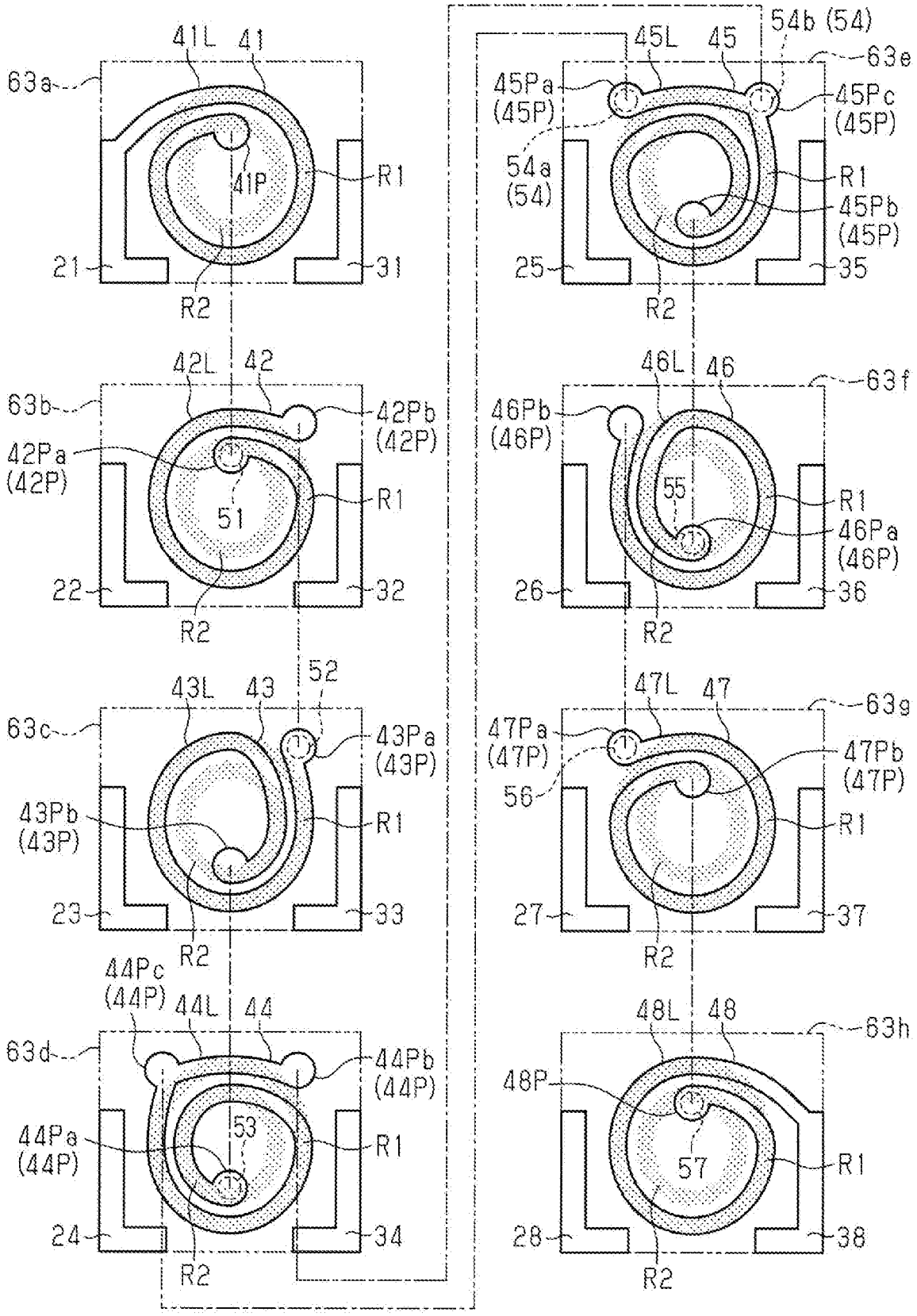
FIG. 4 is a plan view of insulator layers, and shows the coil conductor layers and outer electrode layers.

As shown in FIGS. 3 and 4, the coil 40 includes the plurality of coil conductor layers 41 to 48, and via conductor layers 51 to 57 that connect the coil conductor layers 41 to 48 corresponding thereto. The coil conductor layers 41 to 48 that are wound with a planar shape are formed on the corresponding insulator layers 63*a* to 63*h*. The coil conductor layers 41 to 48 are substantially spirally formed with the number of turns being greater than or equal to about one turn. In FIG. 4, the external shapes of the insulator layers 60 (63*a* to 63*h*) are each shown by an alternate long and two short dash line.

As shown in FIG. 4, the coil conductor layers 41 to 48 of the embodiment are each substantially spirally formed roughly along two substantially ring-shaped tracks R1 and R2. Therefore, the number of turns of each of the coil conductor layers 41 to 48 of the embodiment is greater than or equal to about one turn and less than about two turns.

The via conductor layers 51 to 57 extend through the corresponding insulator layers 63*b* to 63*h* in a thickness direction. In FIG. 3, the via conductor layers 51 to 57 are each shown by an alternate long and short dash line between the corresponding coil conductor layers 41 to 48. In FIG. 4, the via conductor layers 51 to 57 are each shown by a broken line, and portions to which the via conductor layers 51 to 57 are connected are shown by alternate long and short dash lines.

As shown in FIG. 2, the first outer electrode 20 includes the plurality of outer conductor layers 21 to 28. The second outer electrode 30 includes the plurality of outer conductor layers 31 to 38.

The outer conductor layers 21 to 28, and 31 to 38 are provided at the corresponding insulator layers 63*a* to 63*h*. The outer conductor layers 21 to 28 and 31 to 38 each have a substantially L shape. The outer conductor layers 22 to 28 and 32 to 38 extend through the corresponding insulator layers 63*b* to 63*h* in the thickness direction. The outer conductor layers 21 to 28 are connected to each other as shown in FIG. 2 by the corresponding insulator layers 63*a* to 63*h*, and form the substantially L-shaped first outer electrode 20. Similarly, the outer conductor layers 31 to 38 are connected to each other as shown in FIG. 2 by the corresponding insulator layers 63*a* to 63*h*, and form the substantially L-shaped second outer electrode 30.

The coil conductor layers 41 to 48, and the via conductor layers 51 to 57 are each made of a conductive material, such as a metal having a low electrical resistance (for example, silver (Ag), copper (Cu), or gold (Au)) or an alloy whose main component is any of these metals. The outer conductor layers 21 to 28 and 31 to 38 are each made of a conductive material, such as a metal having a low electrical resistance (for example, silver (Ag), copper (Cu), or gold (Au)), or an alloy whose main component is any of these metals.

In FIG. 4, the coil conductor layers 41 to 48 at the corresponding insulator layers 63*a* to 63*h* are described starting from the one on the upper left.

At the insulator layer 63*a*, the coil conductor layer 41 includes a winding portion 41L that is substantially spirally formed from an outer peripheral track R1 to an inner peripheral track R2, and a via pad 41P that is formed on a second end of the winding portion 41L. More specifically, the winding portion 41L includes a portion that extends along the outer peripheral track R1, a portion that extends along the inner peripheral track R2, and a connection portion between the portion that extends along the outer peripheral track R1 and the portion that extends along the inner peripheral track R2. A first end of the winding portion 41L is connected to an upper end of the outer conductor layer 21 of the first outer electrode 20.

At the insulator layer 63*b*, the coil conductor layer 42 includes a winding portion 42L that is substantially spirally formed from an inner peripheral track R2 to an outer peripheral track R1, and via pads 42P (42Pa, 42Pb) that are formed on two ends of the winding portion 42L. Similarly to the coil conductor layer 41, the coil conductor layer 42 includes a portion that extends along the outer peripheral track R1, a portion that extends along the inner peripheral track R2, and a connection portion that connects these portions. The via pad 42Pa is connected to the via pad 41P at the insulator layer 63*a* via the via conductor layer 51 at the insulator layer 63*b*.

At the insulator layer 63*c*, the coil conductor layer 43 includes a winding portion 43L that is substantially spirally formed from an outer peripheral track R1 to an inner peripheral track R2, and via pads 43P (43Pa, 43Pb) that are formed on two ends of the winding portion 43L. Similarly to the coil conductor layer 41, the coil conductor layer 43 includes a portion that extends along the outer peripheral track R1, a portion that extends along the inner peripheral track R2, and a connection portion that connects these portions. The via pad 43Pa is connected to the via pad 42Pb at the insulator layer 63*b* via the via conductor layer 52 at the insulator layer 63*c*.

At the insulator layer 63*d*, the coil conductor layer 44 includes a winding portion 44L that is substantially spirally formed from an inner peripheral track R2 to an outer peripheral track R1, and via pads 44P (44Pa, 44Pb) that are formed on two ends of the winding portion 44L. Similarly to the coil conductor layer 41, the coil conductor layer 44 includes a portion that extends along the outer peripheral track R1, a portion that extends along the inner peripheral track R2, and a connection portion that connects these portions. The coil conductor layer 44 includes a via pad 44Pc at a position that is symmetrical to the via pad 44Pb. The via pad 44Pa is connected to the via pad 43Pb at the insulator layer 63*c* via the via conductor layer 53 at the insulator layer 63*d*.

At the insulator layer 63*e*, the coil conductor layer 45 includes a winding portion 45L that is substantially spirally formed from an outer peripheral track R1 to an inner peripheral track R2, and via pads 45P (45Pa, 45Pb) that are formed on two ends of the winding portion 45L. Similarly to the coil conductor layer 41, the coil conductor layer 45 includes a portion that extends along the outer peripheral track R1, a portion that extends along the inner peripheral track R2, and a connection portion that connects these portions. The coil conductor layer 45 includes a via pad 45Pc at a position that is symmetrical to the via pad 45P. The via pads 45Pa and 45Pc are connected to the corresponding via pads 44Pc and 44Pb at the insulator layer 63*d* via the corresponding via conductor layers 54 (54*a*, 54*b*) at the insulator layer 63*e*.

At the insulator layer 63*f*, the coil conductor layer 46 includes a winding portion 46L that is substantially spirally formed from an inner peripheral track R2 to an outer peripheral track R1, and via pads 46Pa and 46Pb that are formed on two ends of the winding portion 46L. Similarly to the coil conductor layer 41, the coil conductor layer 46 includes a portion that extends along the outer peripheral track R1, a portion that extends along the inner peripheral track R2, and a connection portion that connects these portions. The via pad 46Pa is connected to the via pad 45Pb at the insulator layer 63*e* via the via conductor layer 55 at the insulator layer 63*f*.

At the insulator layer 63*g*, the coil conductor layer 47 includes a winding portion 47L that is substantially spirally formed from an outer peripheral track R1 to an inner peripheral track R2, and via pads 47P (47Pa, 47Pb) that are formed on two ends of the winding portion 47L. Similarly to the coil conductor layer 41, the coil conductor layer 47 includes a portion that extends along the outer peripheral track R1, a portion that extends along the inner peripheral track R2, and a connection portion that connects these portions. The via pad 47Pa is connected to the via pad 46Pb at the insulator layer 63*f* via the via conductor layer 56 at the insulator layer 63*g*.

At the insulator layer 63*h*, the coil conductor layer 48 includes a winding portion 48L that is substantially spirally formed from an inner peripheral track R2 to an outer peripheral track R1, and a via pad 48P that is formed on a first end of the winding portion 48L. Similar to the coil conductor layer 41, the coil conductor layer 48 includes a portion that extends along the outer peripheral track R1, a portion that extends along the inner peripheral track R2, and a connection portion that connects these portions. A second end of the winding portion 48L is connected to an upper end of the outer conductor layer 38 of the second outer electrode 30. The via pad 48P is connected to the via pad 47Pb at the insulator layer 63*g* via the via conductor layer 57 at the insulator layer 63*h*.

The outside diameters of the via pads 41P to 48P are larger than the line widths of the corresponding winding portions 41L to 48L. The via pads 41P to 48P are each, for example, substantially circular. The diameters of the via pads 41P to 48P are larger than the line widths of the corresponding winding portions 41L to 48L. The via pads 41P to 48P may have shapes other than substantially circular shapes, such as substantially polygonal shapes, substantially semicircular shapes, substantially elliptical shapes, or combinations of these shapes.

Manufacturing Method

Next, a method of manufacturing the above-described inductor 1 is described with reference to FIG. 3.

First, a mother insulator layer, which becomes the insulator layer 61, is formed. The mother insulator layer is a large insulator layer in which a plurality of insulator layers 61 in a connected state are arranged in a matrix. For example, an insulating paste whose main component is borosilicate glass is applied to a substantially 8-inch-square carrier film by screen printing, after which the entire insulating paste is exposed to ultraviolet rays. This solidifies the insulating paste, so that the mother insulator layer, which becomes the insulator layer 61, is formed. In the embodiment, an insulating paste having a relative permeability that is less than or equal to about two after firing is used. The insulating paste that is used for the insulator layer 61 is colored differently from insulating pastes that are used for the insulator layers 62, 63*a* to 63*h*, and 64.

Next, a mother insulator layer, which becomes the insulator layer 62, is formed. An insulating paste is applied to the mother insulator layer, which becomes the insulator layer 61, by screen printing, after which the entire insulating paste is exposed to ultraviolet rays, so that the mother insulator layer, which becomes the insulator layer 62, is formed.

Next, a mother insulator layer, which becomes the insulator layer 63*a*, is formed. An insulating paste is applied to the mother insulator layer, which becomes the insulator layer 62, after which the entire insulating paste is exposed to ultraviolet rays, so that the mother insulator layer, which becomes the insulator layer 63*a*, is formed.

Next, by performing a photolithography step, the coil conductor 41 and the outer conductor layers 21 and 31 are formed. For example, a photosensitive conductive paste whose main metal component is Ag is applied to the mother insulator layer, which becomes the insulator layer 63*a*, by printing, so that a conductive paste layer is formed. Next, the conductive paste layer is irradiated with, for example, ultraviolet rays by using a photomask, and is developed with, for example, an alkali solution. This forms the coil conductor layer 41 and the outer conductor layers 21 and 31 at the mother insulator layer, which becomes the insulator layer 63*a*.

Next, a mother insulator layer, which becomes the insulator layer 63*b*, is formed. An insulating paste is applied to the mother insulator layer, which becomes the insulator layer 63*a*, after which the insulating paste is exposed to ultraviolet rays by using a photomask that covers the locations where the via conductor layer 51 and the outer conductor layers 22 and 32 are to be formed. Next, unsolidified portions of the insulating paste are removed by using, for example, an alkali solution. This forms the mother insulating layer, which becomes the insulator layer 63*b*, having a through hole at a location corresponding to where the via pad 41P of the coil conductor layer 41 is formed and whose corners at locations corresponding to where the outer conductor layers 22 and 32 are to be formed are cut out.

Next, by a photolithography step, the coil conductor layer 42, the via conductor layer 51, and the outer conductor layers 22 and 32 are formed. Similarly to the above-described coil conductor layer 41, a photosensitive conductive paste is applied, and a conductive paste layer is formed on the mother insulator layer, which becomes the insulator layer 63*b*. Here, the conductive paste fills the above-described through hole and cut-out portions. Next, the conductive paste layer is irradiated with, for example, ultraviolet rays by using a photomask, and is developed with, for example, an alkali solution. This forms the coil conductor layer 42, the via conductor layer 51, and the outer conductor layers 22 and 32 at the mother insulator layer, which becomes the insulator layer 63*b*.

Thereafter, the step of forming a mother insulator layer and the photolithography step are alternately repeated to form mother insulator layers, which become the insulator layers 63*c* to 63*h*, the coil conductor layers 42 to 48, the outer conductor layers 23 to 28 and 33 to 38, and the via conductor layers 52 to 57.

Next, similarly to the mother insulator layer, which becomes the above-described insulator layer 62, a mother insulator layer, which becomes the insulator layer 64, is formed on the mother insulator layer, which becomes the insulator layer 63*h*. Then, similarly to the mother insulator layer, which becomes the above-described insulator layer 61, a mother insulator layer, which becomes the insulator layer 65, is formed on the mother insulator layer, which becomes the insulator layer 64.

After performing the above-described steps, a mother multilayer body including a plurality of component bodies 10 arranged in a matrix and connected to each other is acquired.

Next, the mother multilayer body is cut with a dicing machine to acquire unfired component bodies 10. In the cutting step, at cut surfaces that are formed by the cutting, the outer conductor layers 21 to 28 and 31 to 38 are exposed from a component body 10. Since the component body 10 contracts during firing (described later), the mother multilayer body is cut considering the contraction.

Next, the unfired component body 10 is fired under predetermined conditions to acquire the component body 10. Further, barrel finishing is performed on the component body 10.

In the case of an inductor including a covering layer, after the barrel finishing, a covering layer that covers the outer conductor layers 21 to 28 and 31 to 38 is formed. For example, the covering layer may be formed by electroplating or electroless plating.

By performing the above-descried steps, the inductor 1 is completed.

The above-described manufacturing method is an exemplification, and may be replaced by other publicly known manufacturing methods or other publicly known manufacturing methods added may be added as long as the structure of the inductor 1 can be realized. For example, mother insulator layers, which become the insulator layers, are formed on a carrier film and, for example, coil conductor layers are formed at required mother insulator layers. It is possible to laminate a plurality of mother insulator layers to acquire the above-described mother multilayer body. For example, the coil conductor layers may be formed by other methods such as printing.

Operation

Next, the operation of the above-described inductor 1 is described.

As shown in FIG. 1, the component body 10 of the inductor 1 has a substantially rectangular parallelepiped shape, and includes the mounting surface 11 at which the first outer electrode 20 and the second outer electrode 30 are exposed. As shown in FIG. 2, the inductor 1 includes the coil 40 that is provided in the component body 10. The first end of the coil 40 is connected to the first outer electrode 20, and the second end of the coil 40 is connected to the second outer electrode 30. The coil 40 includes the plurality of coil conductor layers 41 to 48 that are provided in the width direction W. The coil conductor layers 41 to 48 are each substantially spirally formed with the number of turns being greater than or equal to about one turn. The height T1 of the component body 10 is greater than the width W1 of the component body 10 (T1>W1).

The component body 10 is such that the area of principal surfaces of the plurality of insulator layers 61, 62, 63*a* to 63*h*, 64, and 65 that are laminated in the width direction W is larger than that of an inductor whose width W1 is less than or equal to its height T1. Therefore, it is possible to increase the outside diameter of the coil 40 (coil conductor layers 41 to 48) and to increase the length of the coil 40. Consequently, the range of inductance values (L values) of the inductor 1 that are acquired is increased. In addition, it is possible to increase the inside diameters of the substantially spiral coil conductor layers 41 to 48. Therefore, the Q value of the inductor 1 is increased.

As shown in FIG. 4, the coil conductor layers 41 to 48 include the corresponding winding portions 41L to 48L that are substantially spirally formed from the outer peripheral track R1 to the inner peripheral track R2, and the corresponding via pads 41P to 48P to which the corresponding via conductor layers 51 to 57 are connected. The outside diameters of the via pads 41P to 48P are larger than the line widths of the corresponding winding portions 41L to 48L. The via pads 41P to 48P form the suitable coil 40. From the viewpoint of reducing the resistance value of the coil 40, it is desirable that the via conductor layers 51 to 57 be thick. From the viewpoint of connectivity between the via conductor layers 51 to 57 and the coil conductor layers 41 to 48, it is desirable that the via conductor layers 51 to 57 be thick.

Each of the insulator layers 63*a* to 63*h* is formed by applying an insulating paste by screen printing. The coil conductor layers 41 to 48 and the via conductor layers 51 to 57 are formed by the photolithography step by using a photosensitive conductive paste. When, for example, positional displacement in the manufacturing step is considered, large via pads 41P to 48P are needed in accordance with the size of the via conductor layers 51 to 57.

Figure 5:
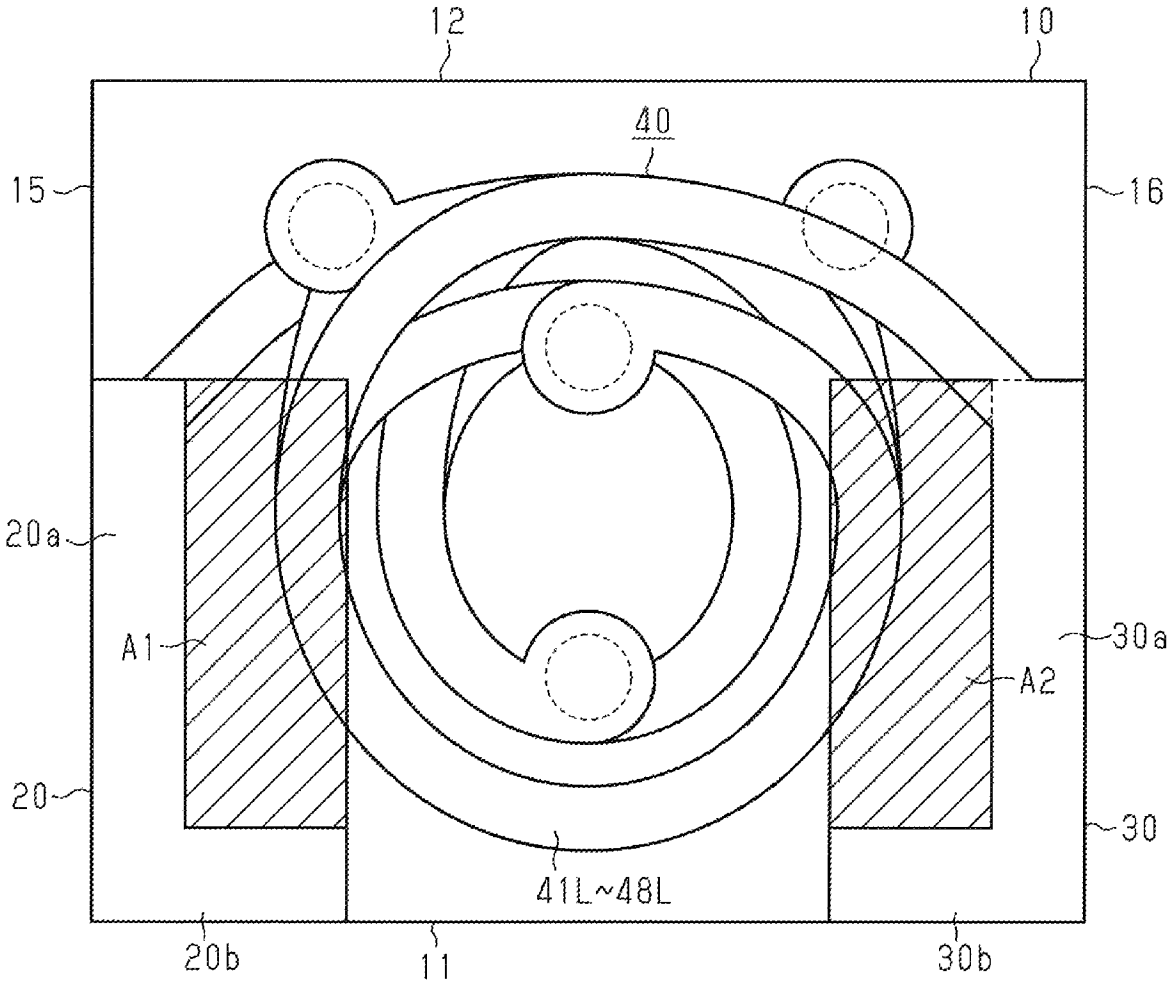
FIG. 5 illustrates the inductor as seen from a lamination direction.

As shown in FIG. 5, the first outer electrode 20 and the second outer electrode 30 of the inductor 1 each have a substantially L shape. At the first outer electrode 20, a via pad is not formed at a first region A1 that overlaps the first outer electrode 20 in a direction perpendicular to the first end surface 15 and in a direction perpendicular to the mounting surface 11. At the second outer electrode 30, a via pad is not formed at a second region A2 that overlaps the second outer electrode 30 in a direction perpendicular to the second end surface 16 and in the direction perpendicular to the mounting surface 11.

When via pads are formed at the first region A1, from the viewpoint of, for example, a short circuit between the via pads and the first outer electrode 20 and parasitic capacitance, the via pads need to be disposed apart from the first outer electrode 20. The outside diameters of the winding portions 41L to 48L of the corresponding coil conductor layers 41 to 48 are correspondingly decreased. Similarly, when via pads are formed at the second region A2, from the viewpoint of, for example, a short circuit between the via pads and the second outer electrode 30 and parasitic capacitance, the via pads need to be disposed apart from the second outer electrode 30. The outside diameters of the winding portions 41L to 48L of the corresponding coil conductor layers 41 to 48 are correspondingly decreased.

Therefore, as in the embodiment, since the via pads are not formed at the first region A1, the winding portions 41L to 48L of the corresponding coil conductor layers 41 to 48 can be formed close to the first outer electrode 20. Similarly, since the via pads are not formed at the second region A2, the winding portions 41L to 48L of the corresponding coil conductor layers 41 to 48 can be formed close to the second outer electrode 30. Therefore, it is possible to increase the outside diameters of the coil conductor layers 41 to 48.

On the other hand, when an attempt is made to form via pads at the first region A1 and the second region A2 and to increase the outside diameters of the coil conductor layers 41 to 48, the via pads are formed on an inner side of the outer peripheral tracks R1 of the corresponding coil conductor layers 41 to 48. This decreases the outside diameters of the inner peripheral tracks R2. That is, the length of the coil 40 is reduced.

In contrast, as in the embodiment, the via pads are not formed at the first region A1, that is, the via pads are formed at locations that do not overlap the first outer electrode 20. Therefore, it is possible to increase the outside diameters of the inner peripheral tracks R2, that is, the inside diameters of the inner peripheral tracks R2. Similarly, the via pads are not formed at the second region A2, that is, the via pads are formed at locations that do not overlap the second outer electrode 30. Therefore, it is possible to increase the outside diameters of the inner peripheral tracks R2, that is, the inside diameters of the inner peripheral tracks R2. By increasing the inside diameters of the inner peripheral tracks R2, the Q value of the inductor 1 is increased.

The via pads that are connected to the winding portions at the corresponding outer peripheral tracks R1 protrude to outer sides of the corresponding outer peripheral tracks R1, and the via pads that are connected to the winding portions at the corresponding inner peripheral tracks R2 protrude to inner sides of the corresponding inner peripheral tracks R2. By forming the via pads at the outer peripheral tracks R1 so as to protrude to the outer sides of the outer peripheral tracks R1, the outside diameters of the winding portions at the inner peripheral tracks R2 are increased. By forming the via pads at the inner peripheral tracks R2 so as to protrude to the inner sides of the inner peripheral tracks R2, the outside diameters of the winding portions at the inner peripheral tracks R2 are increased, that is, the inside diameters of the winding portions are increased. Therefore, it is possible to increase the Q value of the inductor.

As described above, the embodiment provides the following effects.

(1) The component body 10 of the inductor 1 is formed with a substantially rectangular parallelepiped shape, and includes the mounting surface 11 at which the first outer electrode 20 and the second outer electrode 30 are exposed. The inductor 1 includes the coil 40 that is provided in the component body 10. The first end of the coil 40 is connected to the first outer electrode 20, and the second end of the coil 40 is connected to the second outer electrode 30. The coil 40 includes the plurality of coil conductor layers 41 to 48 that are provided in the width direction W. The coil conductor layers 41 to 48 are substantially spirally formed with the number of turns being greater than or equal to about one turn. The height T1 of the component body 10 is greater than the width W1 of the component body 10 (T1>W1).

The component body 10 is such that the area of the principal surfaces of the plurality of insulator layers 61, 62, 63*a* to 63*h*, 64, and 65 that are laminated in the width direction W is larger than that of an inductor whose width W1 is less than or equal to its height T1. Therefore, it is possible to increase the outside diameter of the coil 40 (coil conductor layers 41 to 48) and to increase the length of the coil 40. Therefore, the range of inductance values (L values) of the inductor 1 that are acquired is increased. In addition, it is possible to increase the inside diameters of the substantially spiral coil conductor layers 41 to 48. Therefore, it is possible to increase the Q value of the inductor 1.

(2) The first outer electrode 20 and the second outer electrode 30 each have a substantially L shape, and are embedded in the component body 10. Therefore, compared to a case in which the outer electrodes are externally attached to the component body, it is possible to reduce the size of the inductor 1. In addition, it is possible to increase the efficiency with which the inductance value of the inductor 1 with respect to the mounting area is acquired.

(3) The first outer electrode 20 and the second outer electrode 30 are not formed at the upper surface 12, an upper-surface-12 side of the first end surface 15, and an upper-surface-12 side of the second end surface 16. Therefore, it is possible to increase the Q value of the inductor 1 without intercepting magnetic flux that is generated in the vicinity thereof. On the other hand, the first outer electrode 20 and the second outer electrode 30 are formed on the first end surface 15 and the second end surface 16, respectively, with a length that is substantially equal to ⅔ of the height of the component body 10 from the mounting surface 11 at the first end surface 15 and the second end surface 16, respectively. Therefore, it is possible to ensure adherence to a substrate during mounting.

(4) The plurality of coil conductor layers 41 to 48 include the corresponding substantially spiral winding portions 41L to 48L and the corresponding via pads 41P to 48P provided for connecting the corresponding via conductor layers 51 to 57. The winding portions 41L to 48L each include the portion that extends along the substantially ring-shaped outer peripheral track R1, the portion that extends along the substantially ring-shaped inner peripheral track R2 on an inner side of the outer peripheral track R1, and the connection portion that connects the portion that extends along the outer peripheral track R1 and the portion that extends along the inner peripheral track R2. The via pads are not formed at at least one of the first region A1 that overlaps the first outer electrode 20 in a direction perpendicular to the first end surface 15 and in a direction perpendicular to the mounting surface 11 and the second region A2 that overlaps the second outer electrode 30 in a direction perpendicular to the second end surface 16 and in the direction perpendicular to the mounting surface 11.

The first outer electrode 20 and the second outer electrode 30 that are embedded in the component body 10 act to reduce the outside diameters of the coil conductor layers 41 to 48. However, at least one of the via pads is provided at a location that does not overlap the first outer electrode 20 (second outer electrode) in a direction perpendicular to the first end surface 15 (second end surface 16). Therefore, it is possible to form the winding portions 41L to 48L of the coil conductor layers close to the first outer electrode 20 (second outer electrode 30). Consequently, it is possible to increase the outside diameters of the coil conductor layers 41 to 48.

It is desirable that the via pads 41P to 48P be provided at locations that do not overlap the first outer electrode 20 (second outer electrode 30) in a direction perpendicular to the first end surface 15 (second end surface 16). Even in this case, it is possible to increase the outside diameters of the coil conductor layers 41 to 48.

(5) Each via pad that is connected to the winding portion at a corresponding one of the outer peripheral tracks R1 protrudes to an outer side of the corresponding one of the outer peripheral tracks R1, and each via pad that is connected to the winding portion at the corresponding one of the inner peripheral tracks R2 protrudes to an inner side of the corresponding one of the inner peripheral tracks R2. By forming each via pad at the corresponding outer peripheral tracks R1 so as to protrude to the outer side of the corresponding outer peripheral track R1, the outside diameters of the winding portions at the corresponding inner peripheral tracks R2 are increased. By forming each via pad at the corresponding inner peripheral track R2 so as to protrude to the inner side of the corresponding inner peripheral track R2, the outside diameters of the winding portions at the corresponding inner peripheral tracks R2 are increased, that is, the inside diameters of the winding portions are increased. Therefore, it is possible to increase the Q value of the inductor.

(6) The component body 10 includes the plurality of laminated insulator layers 61, 62, 63*a* to 63*h*, 64, and 65. The coil conductor layers 41 to 48 are each substantially spirally formed at one principal surface of a corresponding one of the insulator layers 63*a* to 63*h*. The plurality of via conductor layers 51 to 57 extend through the corresponding insulator layers 63*b* to 63*h* in the thickness direction. Therefore, the plurality of insulator layers 61, 62, 63*a* to 63*h*, 64, and 65 make it easier to form the component body 10. The via conductor layers 51 to 57 that extend through the corresponding insulator layers 63*b* to 63*h* connect the plurality of coil conductor layers 41 to 48, so that it is possible to easily form the coil 40.

(7) The insulator layers 61, 62, 63*a* to 63*h*, 64, and 65 are each a nonmagnetic body. Therefore, the inductor 1 that is suitable for high-frequency signals can be acquired.

(8) It is desirable that the height of the component body 10 be greater than the width of the component body 10. Since the height of the first outer electrode 20 at the first end surface 15 can be set large with respect to a certain mounting area, it is possible to increase adherence. Similarly, since the height of the second outer electrode 30 at the second end surface 16 can be set large with respect to a certain mounting area, it is possible to increase adherence.

The embodiment may be carried out in the following forms.

In the embodiment, the number of turns of the coil conductor layers may be changed as appropriate. The one coil may be a coil including coil conductor layers of a different number of turns.

In the embodiment, the first outer electrode 20 and the second outer electrode 30 may be formed at surfaces (outer sides) of the component body 10. Such electrodes can be formed by, for example, performing plating, sputtering, or coating and baking on the end portions of the coil conductor layers that are exposed from the component body 10.

In the embodiment, for example, the shape of the coil 40 (the shape of each outer peripheral track R1 and the shape of each inner peripheral track R2), the line width of the coil 40, and the line length of the coil 40 may be changed as appropriate. In addition, for example, the shape of the first outer electrode 20 and the shape of the second outer electrode 30 may be changed as appropriate.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a substantially rectangular parallelepiped component body that includes a mounting surface at which a first outer electrode and a second outer electrode are exposed; and a coil that is provided at the component body, a first end of the coil being connected to the first outer electrode, a second end of the coil being connected to the second outer electrode, wherein the coil includes a plurality of coil conductor layers that are arranged in a first direction parallel to the mounting surface, each of the plurality of coil conductor layers being substantially spirally formed with the number of turns being greater than or equal to one in a plane perpendicular to the first direction, and a plurality of via conductor layers that connect the coil conductor layers that are adjacent to each other in the first direction, and a height of the component body in a direction orthogonal to the mounting surface is larger than a width of the component body in the first direction.

2. The inductor according to claim 1, wherein the component body includes a first end surface and a second end surface that are orthogonal to the mounting surface and that are parallel to the first direction, the first outer electrode is embedded in the component body, and has a substantially L shape so as to be exposed continuously from the mounting surface to the first end surface, and the second outer electrode is embedded in the component body, and has a substantially L shape so as to be exposed continuously from the mounting surface to the second end surface.

3. An inductor comprising:

a substantially rectangular parallelepiped component body that includes a mounting surface at which a first outer electrode and a second outer electrode are exposed; and a coil that is provided at the component body, a first end of the coil being connected to the first outer electrode, a second end of the coil being connected to the second outer electrode, wherein the coil includes a plurality of coil conductor layers that are arranged in a first direction parallel to the mounting surface, the plurality of coil conductor layers being substantially spirally formed with the number of turns being greater than or equal to about one in a plane perpendicular to the first direction, and a plurality of via conductor layers that connect the coil conductor layers that are adjacent to each other in the first direction, and a height of the component body in a direction orthogonal to the mounting surface is larger than a width of the component body in the first direction, wherein the component body includes a first end surface and a second end surface that are orthogonal to the mounting surface and that are parallel to the first direction, the first outer electrode is embedded in the component body, and has a substantially L shape so as to be exposed continuously from the mounting surface to the first end surface, and the second outer electrode is embedded in the component body, and has a substantially L shape so as to be exposed continuously from the mounting surface to the second end surface, wherein the plurality of coil conductor layers each include a substantially spiral winding portion and a via pad for connecting the via conductor layer corresponding thereto, when viewed from the first direction, each winding portion includes a portion that extends along a substantially ring-shaped outer peripheral track, a portion that extends along a substantially ring-shaped inner peripheral track on an inner side of the outer peripheral track, and a connection portion that connects the portion that extends along the outer peripheral track and the portion that extends along the inner peripheral track, and at least one of the plurality of via pads that is provided at the portions that extend along the outer peripheral tracks of the winding portions of the coil is provided at a location that does not overlap the first outer electrode in a second direction perpendicular to the first end surface.

4. An inductor comprising:

a substantially rectangular parallelepiped component body that includes a mounting surface at which a first outer electrode and a second outer electrode are exposed; and a coil that is provided at the component body, a first end of the coil being connected to the first outer electrode, a second end of the coil being connected to the second outer electrode, wherein the coil includes a plurality of coil conductor layers that are arranged in a first direction parallel to the mounting surface, the plurality of coil conductor layers being substantially spirally formed with the number of turns being greater than or equal to about one in a plane perpendicular to the first direction, and a plurality of via conductor layers that connect the coil conductor layers that are adjacent to each other in the first direction, and a height of the component body in a direction orthogonal to the mounting surface is larger than a width of the component body in the first direction, wherein the component body includes a first end surface and a second end surface that are orthogonal to the mounting surface and that are parallel to the first direction, the first outer electrode is embedded in the component body, and has a substantially L shape so as to be exposed continuously from the mounting surface to the first end surface, and the second outer electrode is embedded in the component body, and has a substantially L shape so as to be exposed continuously from the mounting surface to the second end surface, wherein each of the coil conductor layers includes a substantially spiral winding portion and a via pad for connecting the via conductor layer, when viewed from the first direction, each winding portion includes a portion that extends along a substantially ring-shaped outer peripheral track, a portion that extends along a substantially ring-shaped inner peripheral track on an inner side of the outer peripheral track, and a connection portion that connects the portion that extends along the outer peripheral track and the portion that extends along the inner peripheral track, and the via pads are not located at at least one of a first region and a second region, the first region overlapping the first outer electrode in a direction perpendicular to the first end surface and in a direction perpendicular to the mounting surface at the first outer electrode, the second region overlapping the second outer electrode in a direction perpendicular to the second end surface and in the direction perpendicular to the mounting surface at the second outer electrode.

5. The inductor according to claim 3, wherein each via pad that is connected to the winding portion at a corresponding one of the outer peripheral tracks protrudes to an outer side of the corresponding one of the outer peripheral tracks, and each via pad that is connected to the winding portion at a corresponding one of the inner peripheral tracks protrudes to an inner side of the corresponding one of the inner peripheral tracks.

6. The inductor according to claim 1, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

7. The inductor according to claim 6, wherein each insulator layer is a nonmagnetic body.

8. The inductor according to claim 4, wherein each via pad that is connected to the winding portion at a corresponding one of the outer peripheral tracks protrudes to an outer side of the corresponding one of the outer peripheral tracks, and each via pad that is connected to the winding portion at a corresponding one of the inner peripheral tracks protrudes to an inner side of the corresponding one of the inner peripheral tracks.

9. The inductor according to claim 2, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

10. The inductor according to claim 3, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

11. The inductor according to claim 4, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

12. The inductor according to claim 5, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

13. The inductor according to claim 8, wherein the component body includes a plurality of insulator layers that are laminated in the first direction, and each coil conductor layer is substantially spirally formed at one principal surface of a corresponding one of the insulator layers, and the plurality of via conductor layers extend through the insulator layers corresponding thereto in a thickness direction.

14. The inductor according to claim 9, wherein each insulator layer is a nonmagnetic body.

15. The inductor according to claim 10, wherein each insulator layer is a nonmagnetic body.

16. The inductor according to claim 11, wherein each insulator layer is a nonmagnetic body.

17. The inductor according to claim 12, wherein each insulator layer is a nonmagnetic body.

18. The inductor according to claim 13, wherein each insulator layer is a nonmagnetic body.

* * * * *